US009705293B2

(12) United States Patent
Achtstätter et al.

(10) Patent No.: US 9,705,293 B2
(45) Date of Patent: Jul. 11, 2017

(54) CORONA IGNITION DEVICE AND METHOD FOR PRODUCING A CORONA IGNITION DEVICE

(71) Applicant: BorgWarner BERU Systems GmbH, Ludwigsburg (DE)

(72) Inventors: Tom Achtstätter, Hemmingen (DE); Timo Stifel, Stuttgart (DE); Felizitas Heilmann, Gerlingen (DE); Ganghua Ruan, Ludwigsburg (DE); Gerd Bräuchle, Hüffenhardt (DE)

(73) Assignee: BORGWARNER BERU SYSTEMS GMBH, Ludwigsburg (DE)

( * ) Notice: Subject to any disclaimer, the term of this patent is extended or adjusted under 35 U.S.C. 154(b) by 454 days.

(21) Appl. No.: 14/268,226

(22) Filed: May 2, 2014

(65) Prior Publication Data

US 2014/0328003 A1 Nov. 6, 2014

(30) Foreign Application Priority Data

May 6, 2013 (DE) ..... 10 2013 104 643

(51) Int. Cl.
*F23Q 3/00* (2006.01)
*H01T 19/04* (2006.01)
(Continued)

(52) U.S. Cl.
CPC ..... *H01T 19/04* (2013.01); *F02P 23/045* (2013.01); *H01T 13/41* (2013.01); *H01T 13/44* (2013.01);
(Continued)

(58) Field of Classification Search
CPC ..... H01T 19/04; H01T 13/20
(Continued)

(56) References Cited

U.S. PATENT DOCUMENTS 2,571,769 A * 10/1951 Segall ..... H01T 13/44 29/602.1
3,751,354 A * 8/1973 Jones ..... C25D 17/06 204/198
(Continued)

FOREIGN PATENT DOCUMENTS

EP 2 093 416 A1 8/2009
WO WO 2012/032268 A1 3/2012
WO WO 2012/097212 A1 7/2012

*Primary Examiner* — Thienvu Tran
*Assistant Examiner* — Lucy Thomas
(74) *Attorney, Agent, or Firm* — Bose McKinney & Evans LLP

(57) ABSTRACT

The invention relates to a corona ignition device, comprising a center electrode, an insulator surrounding the center electrode, a coil, which is connected to the center electrode, and a housing pipe, in which the coil is arranged. The housing pipe comprises a substrate layer and a conducting layer arranged radially inwardly of the substrate layer. The conducting layer is made of a material having a greater electrical conductivity than the material of the substrate layer. The conducting layer has a thickness of at least 0.1 mm. Also disclosed is a method for producing a corona ignition device, in which, to produce the housing pipe, an inner pipe is inserted into an outer pipe. The invention also relates to a corona ignition device of which the coil is surrounded by a soft-magnetic shielding.

16 Claims, 1 Drawing Sheet

(51) Int. Cl.

| | |
|---|---|
| ***H01T 13/50*** | (2006.01) |
| ***H01T 13/41*** | (2006.01) |
| ***H01T 13/44*** | (2006.01) |
| ***F02P 23/04*** | (2006.01) |

(52) U.S. Cl.
CPC ..... *H01T 13/50* (2013.01); *Y10T 29/49105* (2015.01)

(58) Field of Classification Search
USPC ..... 361/263
See application file for complete search history.

(56) References Cited

U.S. PATENT DOCUMENTS

| | | | | |
|---|---|---|---|---|
| 4,903,674 | A | 2/1990 | Bassett et al. | |
| 8,567,372 | B2 | 10/2013 | Visser et al. | |
| 2008/0276918 | A1* | 11/2008 | Skinner | F02P 3/02 123/635 |
| 2010/0089584 | A1* | 4/2010 | Burns | E21B 43/2401 166/302 |
| 2012/0180743 | A1 | 7/2012 | Burrows et al. | |
| 2012/0212313 | A1 | 8/2012 | Burrows | |
| 2013/0293086 | A1 | 11/2013 | Pariente et al. | |

* cited by examiner

CORONA IGNITION DEVICE AND METHOD FOR PRODUCING A CORONA IGNITION DEVICE

RELATED APPLICATIONS

This application claims priority to DE 10 2013 104 643.6, filed May 6, 2013, which is hereby incorporated herein by reference in its entirety.

BACKGROUND AND SUMMARY

The invention relates to a corona ignition device and to a method for producing a corona ignition device. Corona ignition devices are known from, e.g., WO 2012/032268 A1. This disclosure teaches a way in which a corona ignition device can be improved.

In a corona ignition device according to this disclosure the housing pipe comprises at least two layers, specifically, a substrate layer, for example made of steel, and a conducting layer made of a material that has a greater electrical conductivity than the substrate layer. The conducting layer can consist for example of aluminium, copper or silver and is arranged radially inwardly of the substrate layer. The conducting layer may be placed directly on the inner face of the substrate layer or may cover an intermediate layer, which for example may be provided in order to improve the adhesion of the conducting layer.

With a corona ignition device according to this disclosure the conducting layer has a thickness of at least 0.1 mm. Housing pipes having conducting layers of such a thickness can be produced from sheet metal for example, to which the conducting layer has been applied by roll cladding. A further possibility for producing housing pipes having conducting layers of such a thickness is to insert an inner pipe into an outer pipe. The outer pipe may be a steel pipe, for example. An inner pipe made of a material having a better electrical conductivity, for example aluminium, copper or silver, can be inserted into such a steel pipe.

Production methods of this type are indeed much more complex than a conventional application of conductive layers by means of galvanic deposition. However, it is only possible to produce significantly thinner layers by means of galvanic deposition with reasonable outlay. It has been found within the scope of this disclosure that eddy current losses in a corona ignition device can be reduced and avoided to a much greater extent with thicker conducting layers that have a thickness of at least 0.1 mm, in particular conducting layers having a thickness of 0.15 mm or more, than is possible with thin galvanically produced conducting layers.

In accordance with an advantageous refinement of this disclosure, the conducting layer is covered by a protective layer, for example a lacquer layer. The protective layer preferably has a thickness of less than 20 micrometers, preferably less than 10 micrometers. The risk of damage to the conducting layer during installation of a corona ignition device can be reduced by a protective layer. If the protective layer has a lower conductivity than the conducting layer, this advantage of protection against damage is opposed by the disadvantage of increased eddy current losses. The thinner is the protective layer, the lower are the eddy current losses associated therewith. With a sufficiently thin protective layer, eddy current losses in the protective layer can be negligible.

As already mentioned, a housing pipe for a corona ignition device according to this disclosure can be produced by applying a conducting layer by means of roll cladding to a substrate layer, for example a sheet metal, and by then bending the sheet metal to form a pipe. Abutting longitudinal edges of the sheet metal are then welded to one another. Instead of welding longitudinal edges to one another, it is also possible to arrange opposed edge portions of the sheet metal in an overlapping manner and to then weld these overlapping portions to one another. It is possible to apply a conducting layer by roll cladding with advantageously low manufacturing outlay.

Another possibility is to insert an inner pipe formed of a material that is a good electrical conductor into an outer housing pipe. This production method, compared with pipe production from roll-clad sheet metal, has the advantage that a weld seam running in the longitudinal direction of the pipe and therefore damage to the conducting layer can be avoided. The housing pipe is preferably worked after the insertion of the inner pipe and thereby the diameter of the housing pipe changed. The outer housing pipe can be produced from steel for example. For the inner pipe, which forms the conducting layer, aluminium, copper or silver can be used for example.

By changing the diameter of the composite pipe after the inner pipe has been inserted into an outer housing pipe a very good adhesion of the inner pipe to the outer housing pipe can be achieved. The diameter can be changed by expanding the composite pipe, for example by means of a mandrel. It is also possible instead to reduce the diameter of the composite pipe, for example by drawing said pipe.

A further possibility for reducing the power dissipation lies in surrounding the coil by a soft-magnetic shielding. The soft-magnetic shielding, similarly to the conducting layer, can be arranged as a layer on a substrate layer. The housing pipe is in this case a composite pipe, which comprises a substrate layer, for example made of steel or a nickel-based alloy, and a soft-magnetic shielding layer. The soft-magnetic shielding may also be provided loosely in the housing pipe in the form of a separate sleeve.

The soft-magnetic shielding can be formed of a material that has a coercive force of 1000 A/m, particularly preferably a coercive force of 100 A/m or less. For example, iron-silicon alloys or ferrites can be used for the soft-magnetic shielding. A soft-magnetic shielding may be used alternatively or additionally to a conducting layer. The substrate layer in both cases has the function of increasing the mechanical load-bearing capacity of the housing pipe.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
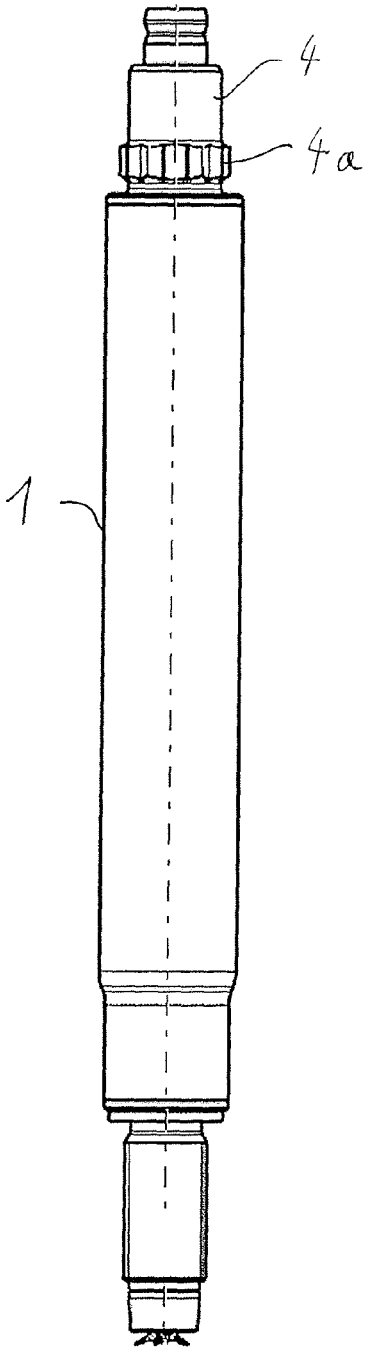
FIG. 1 shows an illustrative embodiment of a corona ignition device.
Figure 2:
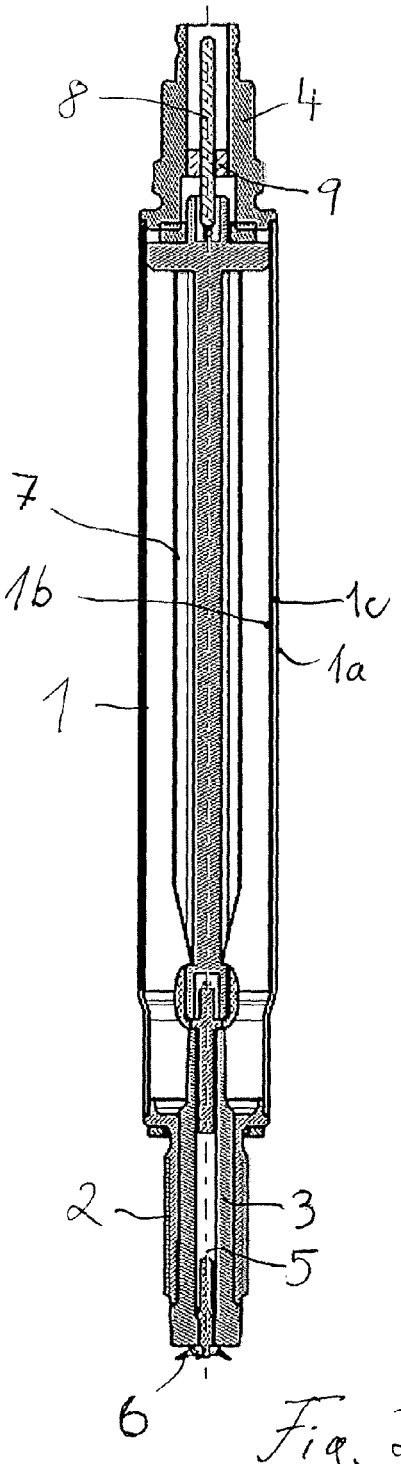
FIG. 2 shows a sectional view of FIG. 1.

The corona ignition device illustrated in FIGS. 1 and 2 has a housing pipe 1, which is closed at a front end on the side of the combustion chamber by a mount 2 surrounding an insulator 3, and is closed at a rear end by a closure piece 4, which can be formed as a plug connector.

As is shown in particular in FIG. 2, a center electrode 5 is surrounded by the insulator 3 and leads to at least one ignition tip 6. The center electrode 5 can be composed of a number of parts, for example pins, which protrude at different ends from the insulator 3 and are connected in the insulator 3 by a glass seal. The glass seal is made of conductive glass, that is to say of glass that has been made electrically conductive by conductive additives, such as graphite particles or metal particles. The glass seal seals a channel leading through the insulator 3. The center electrode 5 sits in this channel, respectively the pins belonging to the center electrode.

The center electrode 5, the insulator 3, and the housing pipe 1 form a capacitor which is connected in series to a coil 7 connected to the center electrode 5. This capacitor and the coil 7 arranged in the housing 1 form an electric oscillating circuit. The excitation of this oscillating circuit can generate corona discharges at the ignition tip or the ignition tips.

The housing pipe 1 has a multi-layered structure with a substrate layer 1*a* and a conducting layer 1*b*, which is arranged radially inwardly of the substrate layer 1*a*, that is to say is surrounded by the substrate layer 1*a*. The conducting layer 1*b* consists of a material that has a greater electrical conductivity than the material of the substrate layer 1*a*. The substrate layer 1*a*, in the embodiment shown, consists of steel or a nickel-based alloy. The conducting layer 1*b* may consist for example of aluminium, copper, silver, or an alloy that is a good electrical conductor, in particular an alloy based on one of the aforementioned metals.

The conducting layer 1*b* has a thickness of more than 0.10 mm, for example a thickness of 0.15 mm or more, preferably a thickness of at least 0.20 mm. The conducting layer 1*b* of the corona ignition device forms a shielding of the coil 7. Eddy current losses are thus reduced considerably, and the efficiency of the corona ignition device is consequently improved.

An intermediate layer 1*c*, for example an adhesive layer for improving the adhesion of the conducting layer 1*b*, may be arranged between the conducting layer 1*b* and the substrate layer 1*a*. The conducting layer 1*b* may also rest directly on the substrate layer 1*a* however.

The conducting layer 1*b* can be covered by a protective layer in order to reduce the risk of damage to the conducting layer 1*b* when assembling the corona ignition device. For example, the protective layer may be a lacquer layer or a ceramic layer, for example an amorphous carbon or silicon layer. The protective layer should be no more than 20 micrometers thick, for example no more than 10 micrometers thick, so that only minimal eddy current losses occur in the protective layer.

The conducting layer 1*b* may form a closed area, for example a cylindrical area. The conducting layer may also have gaps, however, for example along a weld seam, which connects edge portions of a sheet metal that has been plated with the conducting layer and has been bent to form the housing pipe. It is also possible for the conducting layer 1*b* to form a net or grid. Gaps which are smaller than the wavelength of the alternating field to be shielded impair the shielding effect of the conducting layer only slightly, but can facilitate the production of the conducting layer or enable a material saving, which is of economical significance when noble metals, for example gold, are used for the conducting layer 1*b*.

The conducting layer 1*b* may extend over the entire length of the housing pipe 1. It is sufficient however if the conducting layer 1*b* is provided in the portion of the housing pipe 1 surrounding the coil 7. The conducting layer may thus be absent in one or even both end portions of the housing pipe 1. In the embodiment shown, the conducting layer 1*b* extends on both sides in the axial direction slightly further than the coil 7.

The mount 2 for the insulator 3 may have an outer thread for screwing into an engine block. Instead of an outer thread, the corona ignition device may also be fastened to an engine block using other means.

The closure piece 4 may form the outer conductor of a coaxial plug connector, and may surround a metal inner conductor 8 and a glass body 9, which seals an annular gap between the inner conductor 8 and the outer conductor. The glass body 9 can form a compression glass seal for the inner conductor 8. In this embodiment the glass body 9 simultaneously also serves as an insulating support for the inner conductor 8, and it is therefore possible to dispense with further components.

The closure piece 4 preferably has a portion 4*a*, which has an outer face contoured for engagement with a spanner. For example, the portion 4*a* may have a hexagon or double hexagon profile. The functional face of the contoured portion 1*a* may be used to screw the corona ignition device into the thread of an engine. The outer conductor may have further functional faces, for example for latching with a suitable mating plug connector.

The housing pipe 1 of the previously described corona ignition device can be produced for example by using a sheet metal as substrate layer, to which a conducting layer is applied by roll cladding. The sheet metal is then formed into a pipe, wherein opposed edge regions of the sheet metal are welded to one another.

Another possibility for producing a housing pipe 1 for the described corona ignition device is to insert an inner pipe into an outer pipe. The outer pipe then forms the substrate layer, and the inner pipe forms the conducting layer. After or during the insertion of the inner pipe, the composite pipe thus formed can be expanded, that is to say the outer diameter thereof can be enlarged, for example by means of a mandrel. Since the composite pipe is widened, and in so doing its outer diameter is enlarged, its inner diameter is also enlarged and therefore the thickness of the conducting layer is reduced. This has the advantage that an inner pipe having a larger wall thickness can be inserted into the outer pipe. An inner pipe having larger wall thickness is mechanically more stable and can therefore be handled more easily.

Another possibility for producing a housing pipe 1 for a corona ignition device is to insert a wire coil into a pipe that forms the substrate layer, such that this wire coil rests against the inner wall of the pipe. The turns of the wire coil can lie so closely together here that they contact one another or are arranged at a small distance from one another. The wire coil can be fastened to the pipe, for example by annealing the pipe.

Another possibility for producing a housing pipe 1 for a corona ignition device is rolling a foil up into a cylinder and introducing it into a pipe, such that the foil rests against the inner face of the pipe. The foil may then be fastened to the pipe, for example by annealing, thus creating a housing pipe having a substrate layer 1*a* and a conducting layer 1*b*.

Another possibility for producing a housing pipe for a corona ignition device according to this disclosure is overmolding a pipe formed from a material that is a good conductor, for example aluminium, silver or copper, with a material that is less electrically conductive. This further material may be a plastic, for example epoxy resin, or may be a metal, and form the substrate layer. The pipe formed of a material that is a good conductor then forms the conducting layer. Should a plastic be used for overmoulding, the properties of this plastic can be changed by conductive fillers, for example graphite particles, metal powder or ferrite powder, such that the substrate layer 1*b* formed by overmoulding also contributes to the shielding effect.

Instead of a conducting layer 1*b* made of material that is a good electrical conductor, such as aluminium, copper or silver, a soft-magnetic shielding layer can also be applied to the substrate layer 1*a* in order to reduce eddy current losses. Such a shielding layer may consist of an iron-silicon alloy or another soft-magnetic material, for example. Similarly to the conducting layer, the shielding layer may also be applied by roll cladding to a sheet metal from which the housing pipe 1 is then produced. It is also possible to insert an inner pipe made of soft-magnetic material into an outer pipe.

The magnetic shielding can be further improved if the soft-magnetic shielding extends radially inwardly ahead of and behind the two ends of the coil 7, the prepositions "ahead of" and "behind" referring to the axial direction. This can be achieved for example in that the mount 2 for the insulator 3 and/or the closure piece 4 likewise carry a magnetic shielding layer on their inner face facing the coil 7. A further possibility lies in inserting one or more rings made of soft-magnetic material into the housing pipe 1 before or after the coil 7.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE NUMBERS

1. housing pipe
1*a*. substrate layer
1*b*. conducting layer
1*c*. intermediate layer
2. mount for insulator
3. insulator
4. closure piece
4*a*. closure piece portion
5. center electrode
6. coil
7. ignition tip
8. inner conductor
9. glass body

What is claimed is:

1. A corona ignition device, comprising:
a center electrode;
an insulator surrounding the center electrode;
a coil connected to the center electrode;
a housing pipe in which the coil is arranged, the housing pipe comprising a substrate layer and a conducting layer arranged radially inwardly of the substrate layer, the conducting layer being supported by the substrate layer to thereby form a composite tubular pipe, the conducting layer having a thickness of at least 0.1 mm and being made of a material having a greater electrical conductivity than the material of the substrate layer; and
wherein the substrate layer of the housing pipe is produced from sheet metal, to which the conducting layer has been applied by roll cladding and a longitudinally extending weld secures the substrate layer and conducting layer in a tubular form.

2. The corona ignition device according to claim 1, wherein the conducting layer is made of copper or silver.

3. The corona ignition device according to claim 1, wherein the substrate layer is made of steel or a nickel-based alloy.

4. The corona ignition device according to claim 1, wherein the conducting layer is covered by a protective layer.

5. The corona ignition device according to claim 4, wherein the protective layer is a lacquer layer.

6. The corona ignition device according to claim 1, further comprising an intermediate layer arranged between the conducting layer and the substrate layer.

7. A method for producing a corona ignition device comprising the following steps:
inserting a center electrode into an insulator and connecting the center electrode to a coil;
arranging the coil in a housing pipe;
fastening a mount of the insulator to a front end of the housing pipe; and
fastening a closure piece to a rear end of the housing pipe;
wherein the housing pipe is produced by inserting an inner pipe into an outer pipe, and wherein the inner pipe is formed of a material having a greater electrical conductivity or a lower coercive force than the material of the outer pipe; and
securing the inner pipe and outer pipe together to form a composite pipe by changing the diameter of at least one of the inner and outer pipes after inserting the inner pipe into the outer pipe to thereby securely engage the inner and outer pipes with each other.

8. The method according to claim 7, wherein after or during the insertion of the inner pipe, the housing pipe is expanded, thereby increasing the outer diameter thereof.

9. The corona ignition device of claim 1 wherein the longitudinally extending weld secures together abutting longitudinal edges of the sheet metal substrate layer.

10. The corona ignition device of claim 1 wherein the longitudinally extending weld secures together overlapping edge portions of the sheet metal substrate layer.

11. A corona ignition device, comprising:
a center electrode;
an insulator surrounding the center electrode;
a coil connected to the center electrode; and
a housing pipe in which the coil is arranged, the housing pipe comprising an outer pipe having a substrate layer and an inner pipe having a conducting layer, the inner pipe being arranged radially inwardly of the outer pipe wherein at least one of the inner and outer pipes have had their diameter changed after positioning the inner pipe within the outer pipe to forcibly engage the inner and outer pipes together along an axial length of the inner and outer pipes and wherein the inner and outer pipes are secured together by the engagement of the inner and outer pipes along the axial length of the inner and outer pipes to thereby form a composite tubular pipe, the conducting layer having a thickness of at least 0.1 mm and being made of a material having a greater electrical conductivity than the material of the substrate layer.

12. The corona ignition device according to claim 11, wherein the conducting layer is made of copper or silver.

13. The corona ignition device according to claim 11, wherein the substrate layer is made of steel or a nickel-based alloy.

14. The corona ignition device according to claim 11, wherein the conducting layer is covered by a protective layer.

15. The corona ignition device according to claim 14, wherein the protective layer is a lacquer layer.

16. The corona ignition device according to claim 11, further comprising an intermediate layer arranged between the conducting layer and the substrate layer.

* * * * *